US010478740B2

(12) United States Patent
Sakai

(10) Patent No.: US 10,478,740 B2
(45) Date of Patent: Nov. 19, 2019

(54) FUSIBLE TOY BEAD CREATING APPARATUS

(71) Applicant: EPOCH COMPANY, LTD., Tokyo (JP)

(72) Inventor: Ryo Sakai, Tokyo (JP)

(73) Assignee: EPOCH COMPANY, LTD., Tokyo (JP)

( * ) Notice: Subject to any disclaimer, the term of this patent is extended or adjusted under 35 U.S.C. 154(b) by 0 days.

(21) Appl. No.: 15/976,908

(22) Filed: May 11, 2018

(65) Prior Publication Data

US 2018/0333653 A1 Nov. 22, 2018

(30) Foreign Application Priority Data

May 16, 2017 (JP) ..... 2017-097037

(51) Int. Cl.
*A63H 33/06* (2006.01)
*A63H 33/14* (2006.01)
*A63H 33/00* (2006.01)

(52) U.S. Cl.
CPC ..... *A63H 33/06* (2013.01); *A63H 33/00* (2013.01); *A63H 33/001* (2013.01); *A63H 33/14* (2013.01)

(58) Field of Classification Search
CPC ..... A63H 33/00; A63H 33/06; A63H 33/14; A63H 33/32; A63H 33/001; A44C 27/00; B44C 3/12; B44C 3/123; B44C 3/04
See application file for complete search history.

(56) References Cited

U.S. PATENT DOCUMENTS 2,111,163 A * 3/1938 Yecny ..... F26B 25/18 34/282
3,276,350 A * 10/1966 Johns ..... A47J 29/02 126/369
3,794,327 A * 2/1974 Washington ..... A63F 3/00895 273/287
5,704,789 A * 1/1998 Yang ..... B44C 3/123 221/185

(Continued)

FOREIGN PATENT DOCUMENTS

JP 2005-34429 A 2/2005
JP 2011-139820 A 7/2011

(Continued)

OTHER PUBLICATIONS

Notification of Reasons for Refusal dated Dec. 21, 2017 for the corresponding JP 2017-097037, including English language translation.

(Continued)

*Primary Examiner* — Eugene L Kim
*Assistant Examiner* — Alyssa M Hylinski
(74) *Attorney, Agent, or Firm* — Drinker Biddle & Reath LLP

(57) ABSTRACT

A fusible toy bead creating apparatus includes: a table including a first surface and a second surface opposite to the first surface and a receiver. The table has a plurality of penetration holes penetrating from the first surface to the second surface to allow fusible toy beads to be placed on the first surface. The receiver includes a receiving surface arranged to face the first surface of the table and configured to receive the fusible toy beads.

5 Claims, 10 Drawing Sheets

(56) References Cited

U.S. PATENT DOCUMENTS

| | | | | |
|---|---|---|---|---|
| 8,870,185 | B2 * | 10/2014 | Cheng | A63F 3/00574 273/276 |
| 9,956,495 | B2 * | 5/2018 | Kamiyama | A63H 33/14 |
| 2008/0011770 | A1 * | 1/2008 | Tobias | B44B 9/00 221/189 |
| 2009/0173747 | A1 * | 7/2009 | Reynolds | A63H 33/00 221/122 |
| 2012/0186748 | A1 * | 7/2012 | Kamiyama | A63H 9/00 156/349 |
| 2013/0183881 | A1 * | 7/2013 | Kamiyama | B44C 3/12 446/87 |
| 2013/0236679 | A1 * | 9/2013 | Bizzotto | B23P 11/00 428/67 |
| 2016/0354705 | A1 * | 12/2016 | Poulus | A63H 33/086 |
| 2017/0087480 | A1 * | 3/2017 | Poulus | A63H 33/086 |
| 2018/0043276 | A1 | 2/2018 | Sakai | |

FOREIGN PATENT DOCUMENTS

| | | | | |
|---|---|---|---|---|
| JP | 2012-152234 | A | | 8/2012 |
| JP | 2015-181915 | A | | 10/2015 |
| JP | 6108650 | B1 | | 4/2017 |
| KR | 2011005646 | U | * | 6/2011 |
| RU | 2602921 | C1 | | 11/2016 |
| RU | 170904 | U1 | | 5/2017 |

OTHER PUBLICATIONS

Federal Institute of Industrial Property, Office Action for Russian Patent Application No. 2018117567/05(027409), dated Mar. 5, 2019.

* cited by examiner

FUSIBLE TOY BEAD CREATING APPARATUS

CROSS-REFERENCES TO RELATED APPLICATIONS

This application is based on and claims priority from Japanese Patent Application No. 2017-097037 filed on May 16, 2017, the entire contents of which are incorporated herein by reference.

FIELD

One or more embodiments of the invention relate to a creating apparatus for arranging fusible toy beads thereon to create an assembly of the fusible toy beads.

BACKGROUND

In a related art, there is an apparatus for removing an assembly of fusible toy beads placed on a fusible toy bead creating apparatus before the fusible toy beads are completely dried to allow creation of a next assembly of fusible toy beads. For example, the JP-B-6108650 discloses a fusible toy bead scraper including a spatula having an uneven shape in a plan view.

The fusible toy beads are, for example, formed by compounding polyvinyl alcohol with resin and kneading it into granular shapes. After the fusible toy beads are placed on a holding tray, water is supplied to the fusible toy beads by a spray or the like to get them wet, whereby the fusible toy beads are melted. Next, when they are left for a predetermined time and dried, the melted resin cures, thereby connecting together the fusible toy beads. Thus, children, who are main users of the fusible toy beads, can enjoy creating an assembly of fusible toy beads in a desired pattern.

SUMMARY

In the fusible toy bead scraper disclosed in JP-B-6108650, after the surface of the assembly of the fusible toy beads on the fusible toy bead creating apparatus is dried to a certain degree, the assembly of the fusible toy beads is removed from the fusible toy bead creating apparatus. Thus, a next assembly of fusible toy beads can be created. However, a child creating an assembly of fusible toy beads, in some cases, immediately after creating one assembly of fusible toy beads, wants to create another assembly of fusible toy beads.

An object of one or more embodiments of the invention is to provide a fusible toy bead creating apparatus which can start to create a next assembly of fusible toy beads in a short time.

In one or more embodiments of the invention, there is provided a fusible toy bead creating apparatus including: a table including a first surface and a second surface opposite to the first surface and having a plurality of penetration holes penetrating from the first surface to the second surface to allow fusible toy beads to be placed on the first surface; and a receiver including a receiving surface arranged to face the first surface of the table and configured to receive the fusible toy beads by reversing the receiver together with the table to move the fusible toy beads for drying.

According to one or more embodiments of the invention, it is possible to start to create a next assembly of fusible toy beads in a short time.

BRIEF DESCRIPTION OF DRAWINGS

FIG. 4A is an enlarged plan view of the P portion; FIG. 4B is an enlarged perspective view of the P portion; and, FIG. 4C is a section view taken along the IV(c)-IV (c) of FIG. 4A.

DETAILED DESCRIPTION

Figure 1:
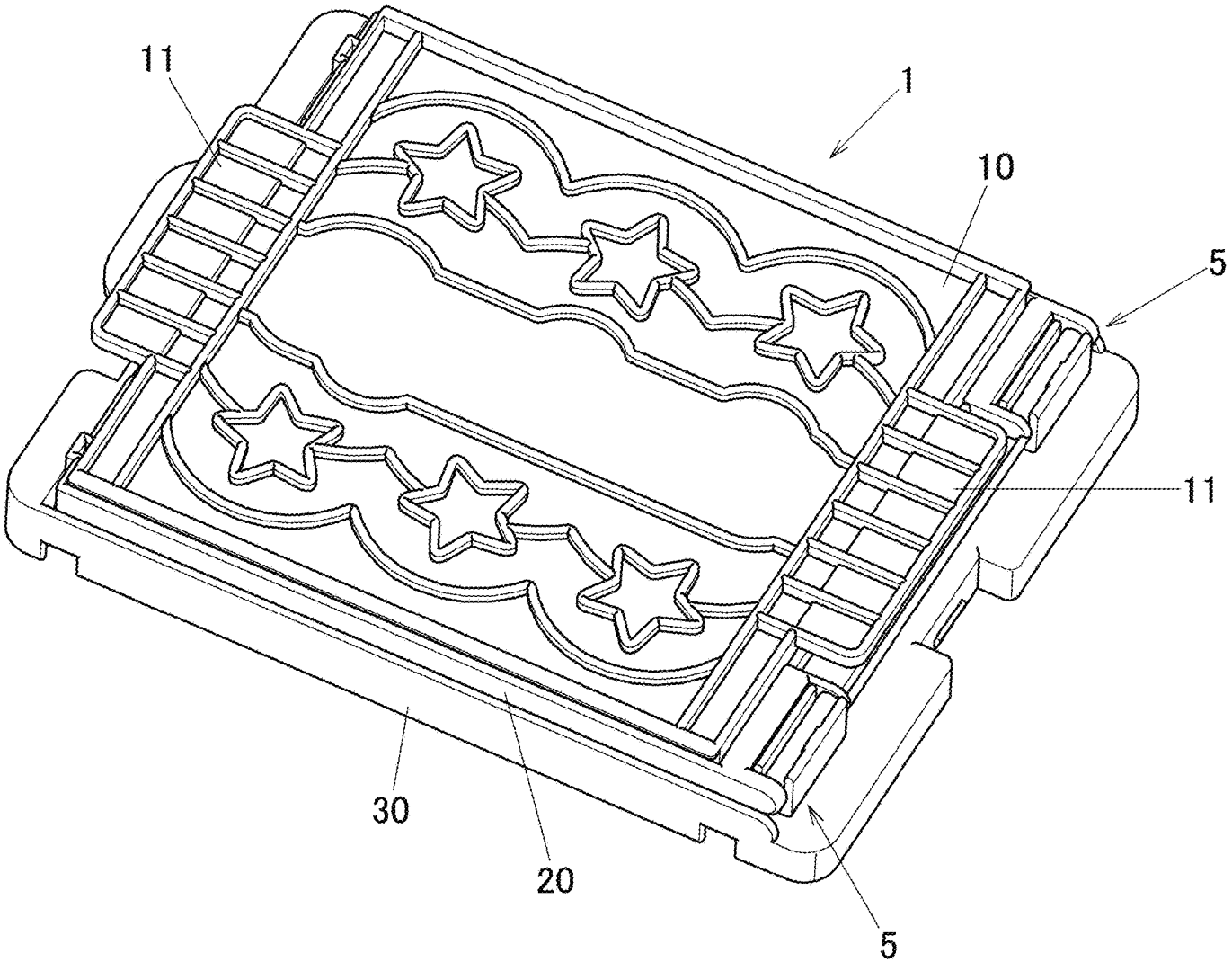
FIG. 1 is a perspective view of an external appearance of a fusible toy bead creating apparatus according to an embodiment of the invention.
Figure 2:
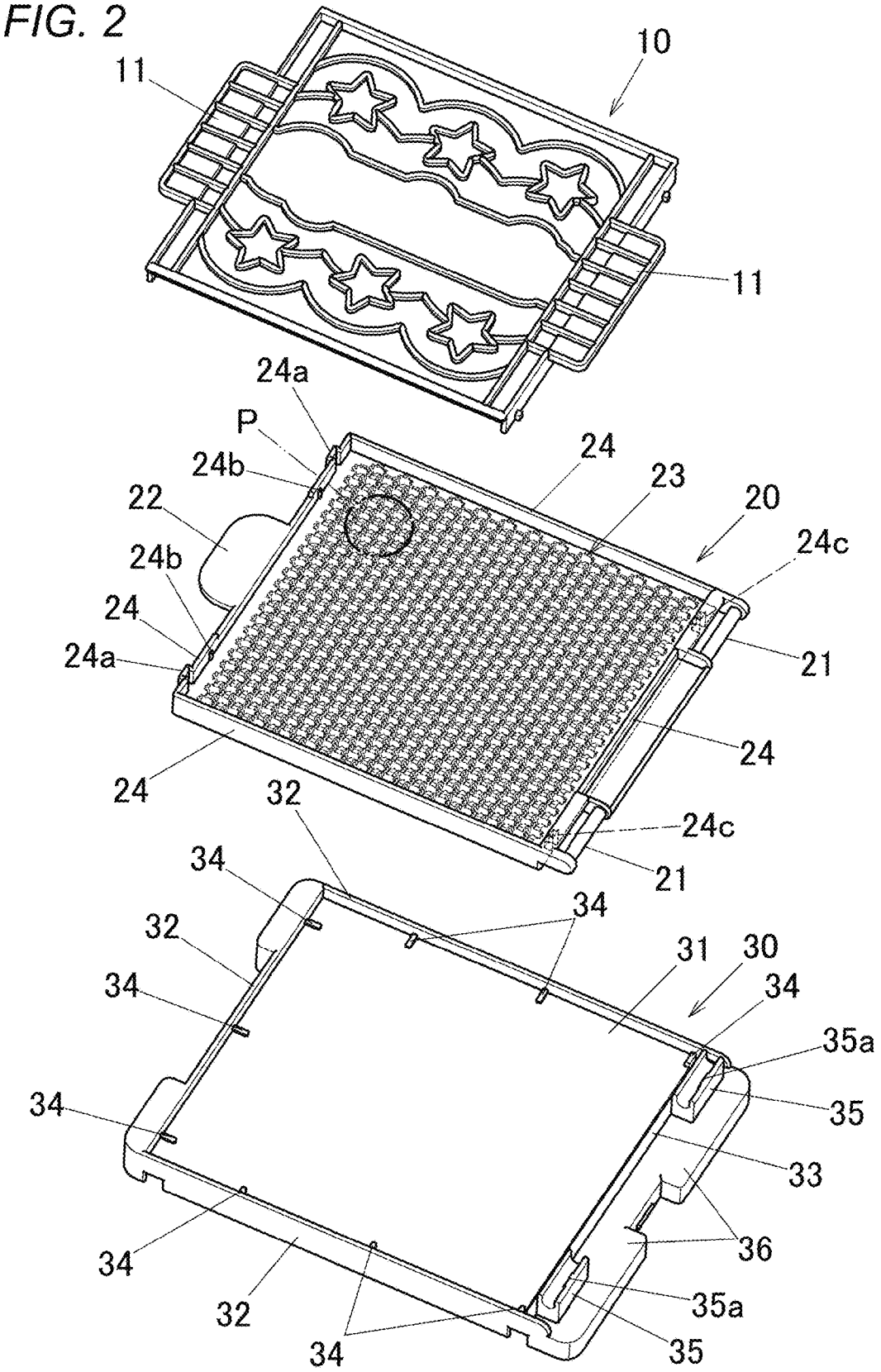
FIG. 2 is an exploded perspective view of a fusible toy bead creating apparatus according to the embodiment of the invention.
Figure 3:
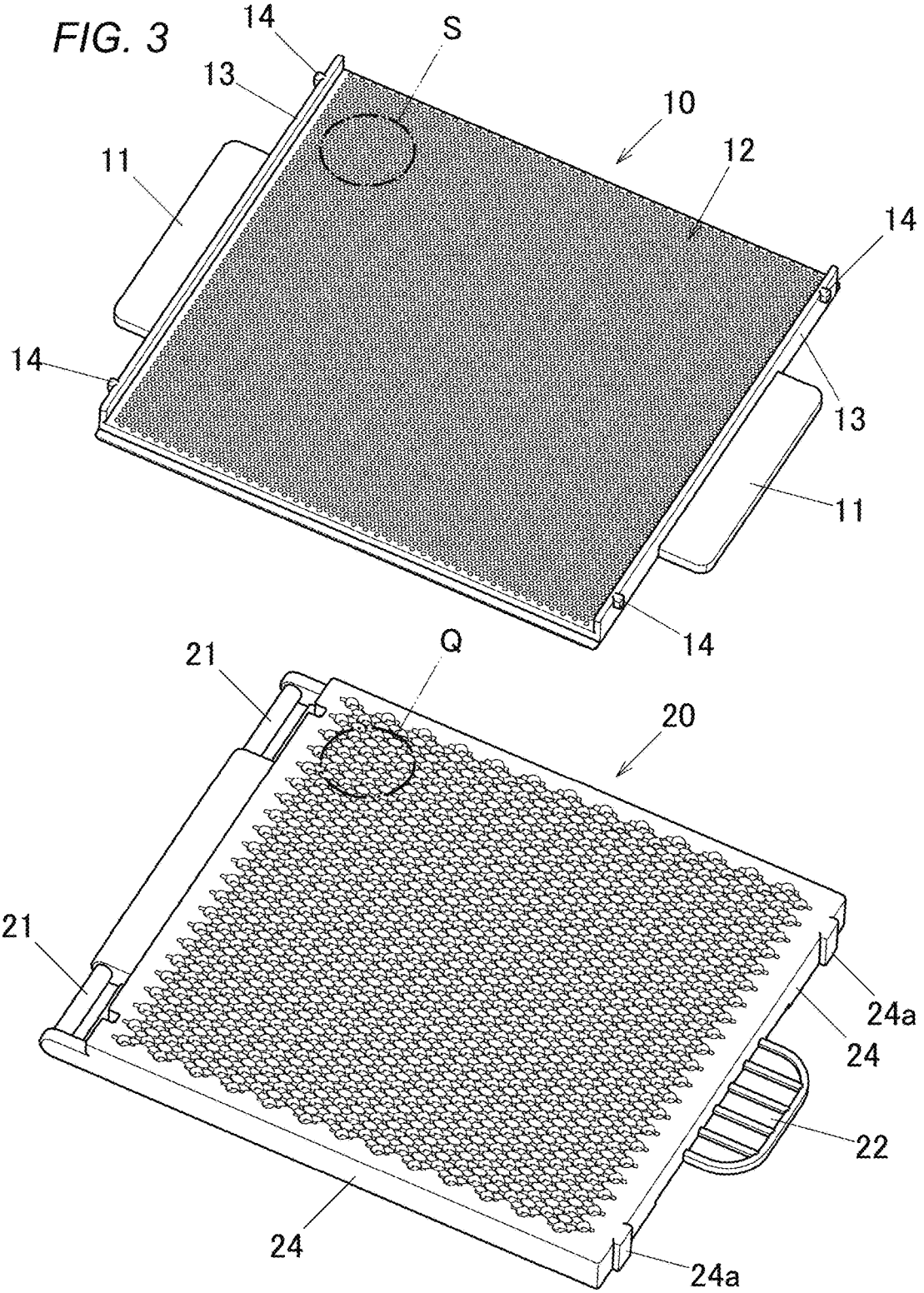
FIG. 3 is a perspective view of back surfaces of a receiver and a table included in the fusible toy bead creating apparatus according to the embodiment of the invention.

Next, an embodiment of the invention is described with reference to the drawings. FIG. 1 is a perspective view of an external view of a fusible toy bead creating apparatus 1, and FIG. 2 is an exploded perspective view of the fusible toy bead creating apparatus 1. The fusible toy bead creating apparatus 1 is formed in a substantially flat plate having a substantially long rectangular shape as a whole. In the fusible toy bead creating apparatus 1, a receiver 10, a table 20, and a tray 30 are arranged sequentially from above in a superimposed manner. Also, FIG. 3 is a perspective view in which the receiver 10 and table 20 are reversed right and left, and are viewed from the back surfaces thereof.

Figure 6:
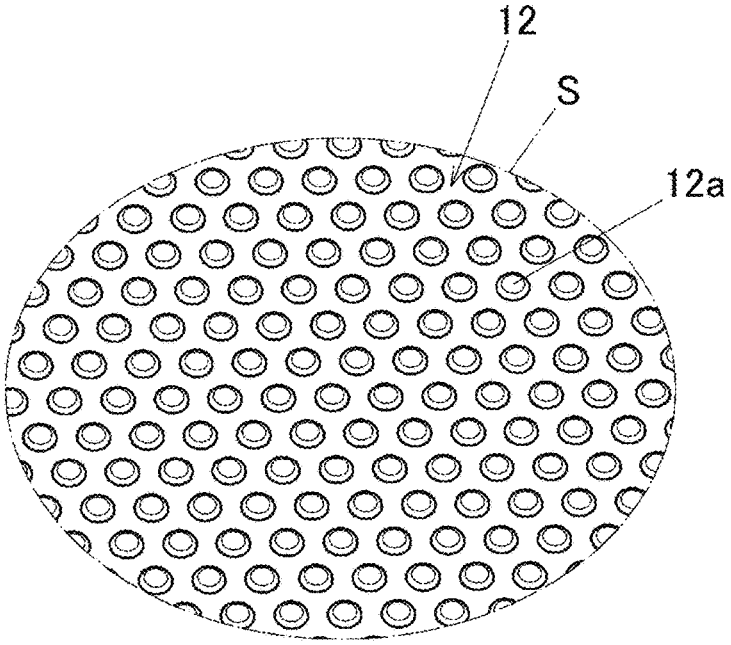
FIG. 6 is an enlarged view of the S portion of FIG. 3 of the fusible toy bead creating apparatus according to the embodiment of the invention.

As shown in FIGS. 1 and 2, the receiver 10 is formed in a substantially flat plate having a substantially long rectangular shape. The receiver 10 includes, in its two short-side portions, flat plate-shaped handles 11 respectively protruding outward. A star shape and a pattern are applied on a front surface (a first surface) of the receiver 10. This allows a child to play happily. As shown in FIG. 3, on a back surface of the receiver 10 serving as a second surface existing on the opposite side to the first surface, there is formed a receiving surface 12. As described later, the receiving surface 12 is a surface configured to receive one or more fusible toy beads 60 (see FIG. 7) placed on the table 20. As shown in FIG. 6 which is the enlarged view of the S portion of FIG. 3, a plurality of protrusions 12*a* are formed on the receiving surface 12. Each of the protrusions 12*a* has, for example, a substantially circular flat shape. The protrusions 12*a* are arranged such that adjacent rows and columns thereof are offset. Also, as shown in FIG. 3, the receiver 10 includes wall parts 13 formed so as to stand from both short-side portions of the back surface. Each of the wall parts 13 includes two vertical ribs 14 on the outside thereof.

As shown in FIG. 2, the table 20 is formed in a substantially flat plate having a substantially long rectangular shape. Two cylindrical shafts 21 each having an axis arranged in parallel with the short-side direction of the table 20 are provided in the two portions of the short-side portion thereof shown right in FIG. 2. The shafts 21 are formed in the vicinity of the two long-side portions of the table 20. Meanwhile, in the short-side portion of the table 20 shown left in FIG. 2 (in other words, on the opposite side to the shaft 21), a handle 22 protruding outward in a substantially flat plate shape is formed.

In the front surface of the table 20 serving as the first surface thereof, a placement part 23 is formed. On the placement part 23, the fusible toy beads 60 (see FIG. 7) can be placed. On the outer peripheries of the placement part 23, wall portions 24 each standing from the front surface are formed. Thus, even when the fusible toy beads 60 roll on the placement part 23, fall-off of the fusible toy beads 60 to the outside of the table 20 can be reduced. Recesses 24*a* are formed in the vicinity of two ends of the wall portion 24 formed on the side where the handle 22 is formed. In two locations on the inner surface side of the wall portion 24 where the recesses 24*a* are formed, vertical ribs 24*b* are formed. Further, in the wall portion 24 opposing the wall portion 24 where the recesses 24*a* are formed (in other words, in the wall portion 24 where the shaft 21 is formed), engagement holes 24*c* are formed at positions opposing the recesses 24*a*.

Figure 4A:
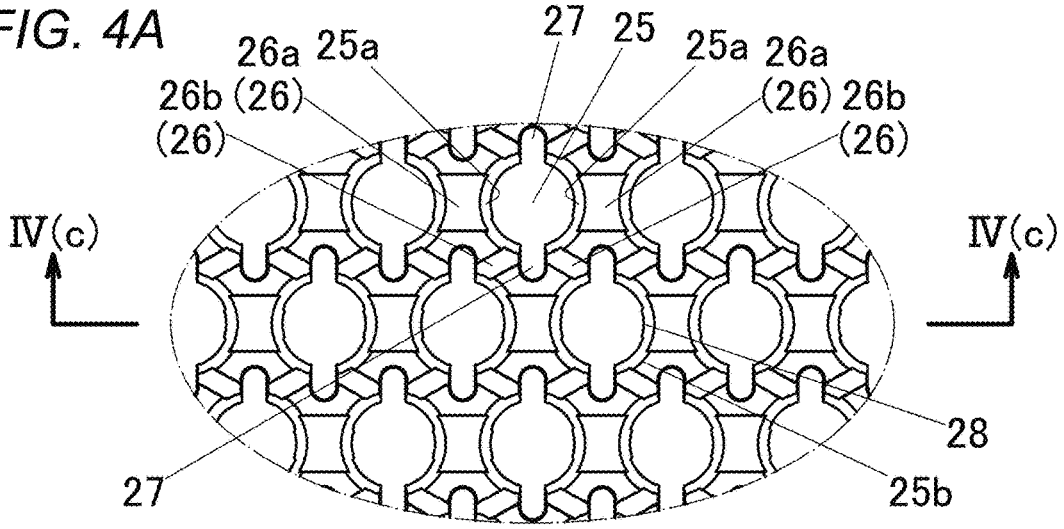
FIGS. 4A to 4C are enlarged views of the P portion of FIG. 2 of a placement part of the fusible toy bead creating apparatus according to the embodiment of the invention, specifically.
Figure 4B:
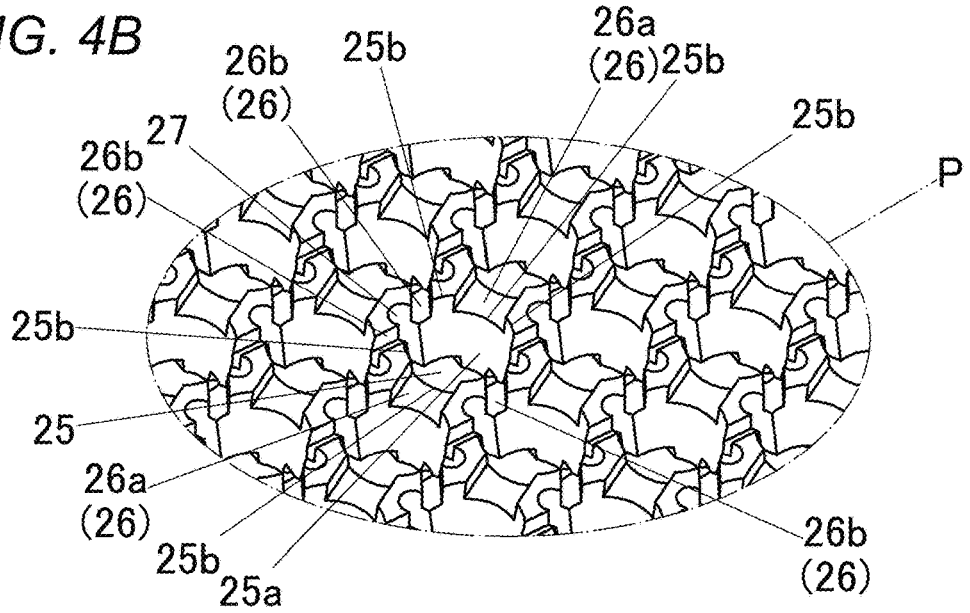
Figure 4C:
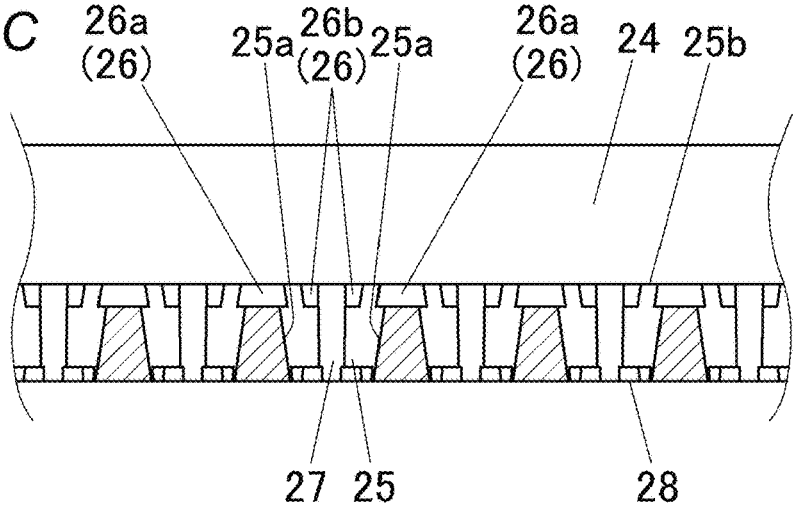

Here, as shown in FIGS. 4A to 4C which are the enlarged views of the P portion in FIG. 2, the placement part 23 of the table 20 has a plurality of penetration holes 25 each of which has a substantially circular cross section and penetrates from the front surface serving as the first surface to the back surface serving as the second surface. As shown in FIG. 4C, an inner peripheral surface 25*a* of the penetration hole 25 is formed in a tapered shape whose diameter reduces gradually from the first surface toward the second surface. Also, the penetration holes 25 are arranged in the table 20 such that they are offset in the directions of the rows and columns thereof. As used herein, the left and right in FIG. 4A are expressed as the short-side direction of the table 20.

In a hole edge 25*b* of each penetration hole 25 of the placement part 23 serving as the first surface (front surface) of the table 20, a first surface side connecting groove 26 connected to its adjacent penetration holes 25 is formed. The first surface side connecting groove 26 includes: a linear groove 26*a* connected to the adjacent penetration holes 25 in the short-side direction (that is, in the left and right direction in FIG. 4A) of the table 20; and an inclined groove 26*b* to be connected to the adjacent penetration holes 25 in an oblique direction. Further, each penetration hole 25 has two recess holes 27 respectively formed in two locations opposite to each other in the longitudinal direction of the table 20 with respect to the center of the penetration hole 25. Each recess hole 27 is recessed in the radially outward direction from the inner peripheral surface of the penetration hole 25 and penetrates from the first surface (front surface) to the second surface (back surface) along the axial direction of the penetration hole 25.

Figure 5:
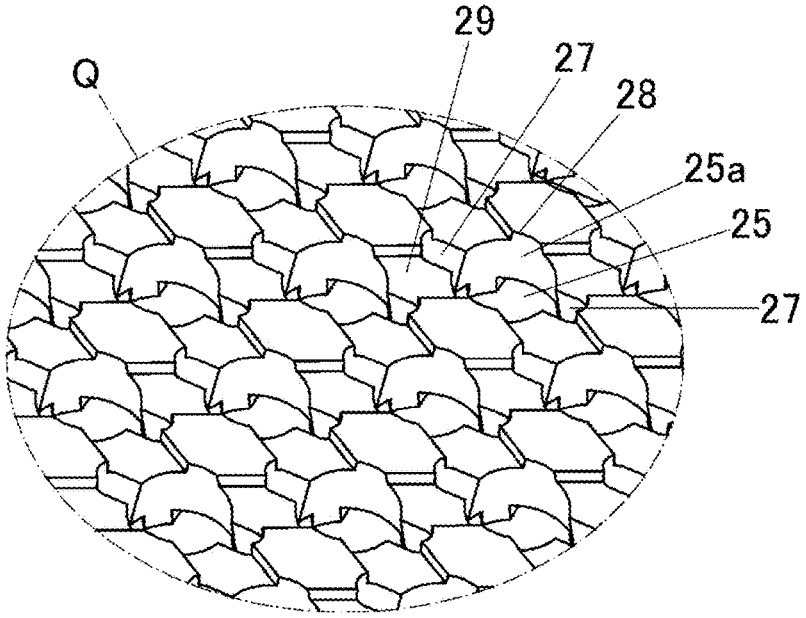
FIG. 5 is an enlarged view of the Q portion of FIG. 3 of the fusible toy bead creating apparatus according to the embodiment of the invention.

In a hole edge 28 of the penetration hole 25 in the second surface (back surface) of the table 20 shown in FIG. 5, a second surface side connecting groove 29 connected to its adjacent penetration hole 25. The second surface side connecting groove 29 connects adjacent penetration holes 25 in the inclined direction.

As shown in FIG. 2, the tray 30 arranged on the second surface (back surface) side of the table 20 is formed in a substantially flat plate having a substantially long rectangular shape. The tray 30 includes, on the front surface (first surface) side thereof, a water receiving surface 31 formed as a flat surface having a substantially long rectangular shape. On the sides of two long-side portions of the water receiving surface 31 and on the side of a short-side portions thereof shown left in FIG. 2, wall parts 32 respectively standing from the water receiving surface 31 are formed. On the side of a short-side portion of the water receiving surface 31 shown right in FIG. 2, a groove part 33 extending in the short-side direction is formed. Thus, of water spayed to the fusible toy beads 60 placed on the table 20, excess water flowing down from the table 20 is received and stored in the water receiving surface 31, wherein the wall part 32 and the groove part 33 can reduce scattering of the water to the outside of the water receiving surface 31.

Further, from each of the wall parts 32 formed on the sides of the two long-side portions and on the side of the left short-side portions of the water receiving surface 31, three support ribs 34 are formed to protrude toward above the water receiving surface 31. On the outside of the groove part 33, two shaft supports 35 are arranged in the vicinity of the inside of the wall part 32 on the side of the two long-side portions. Each shaft support 35 is formed in a substantially U-shaped groove whose upper portion is opened. The shaft support 35 includes a shaft holding protrusion 35*a* on the opening end portion thereof. Below the respective shaft supports 35, a flat plate 36 is formed to protrude outward.

The shafts 21 of the table 20 are inserted into the shaft supports 35 from above and are rotatably supported by the shaft supports 35, respectively, thereby forming a set of hinge parts 5. The hinge parts 5 enable the table 20 to rotate or flip around the shafts 21. Thus, the table 20 is mounted on the tray 30 to be capable of turning over. The second surface (back surface) of the table 20 is supported by the support ribs 34 of the tray 30. Therefore, in a state where the table 20 is set such that the second surface (back surface) of the table 20 and water receiving surface 31 face each other, there is formed a clearance between the second surface (back surface) of the table 20 and water receiving surface 31, whereby water flowing down from the table 20 is allowed to drop down smoothly onto the water receiving surface 31. Further, since the second surface (back surface) of the table 20 has the second surface side connecting grooves 29 around the hole edges 28 of the penetration holes 25, sticking of the second surface (back surface) of the table 20 to the water receiving surface 31 due to the surface tension of water can be reduced.

Next, a procedure for creating an assembly of fusible toy beads 60 using the fusible toy bead creating apparatus 1 is described with reference to FIGS. 7 to 9. Here, as the fusible toy beads 60, well-known fusible toy beads may be used. For example, the fusible toy beads 60 are formed by compounding polyvinyl alcohol with resin and kneaded it. In this embodiment, each of the fusible toy beads 60 has a spherical shape. However, the fusible toy beads 60 may be formed in a polyhedral shape or the like. Fusible toy beads 60 of various colors can also be used.

Figure 7:
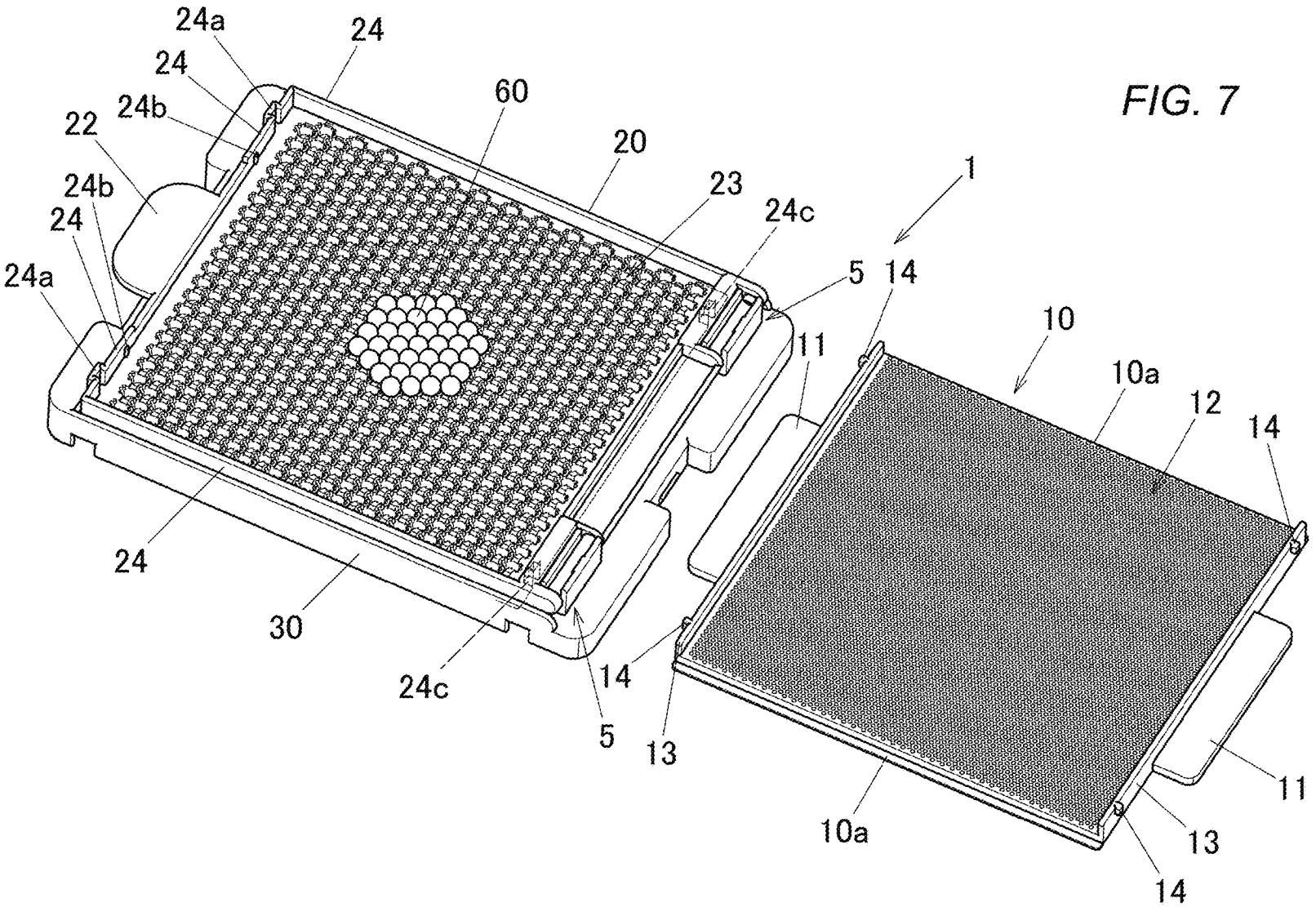
FIG. 7 is a perspective view showing a step of creating an assembly of fusible toy beads by the fusible toy bead creating apparatus according to the embodiment of the invention, specifically, a step of placing toy beads on the table.

Firstly, as shown in FIG. 7, in a state where the receiver 10 is removed from the table 20, the plurality of fusible toy beads 60 are placed on the hole edges 25*b* of the plurality of penetration holes 25 in the placement part 23 of the table 20 to create an arbitrary pattern. Thereafter, using a spray or the like, a sufficient amount of water is applied to the plurality of fusible toy beads 60 placed on the placement part 23.

After application of a sufficient amount of water to the plurality of fusible toy beads 60 placed on the placement part 23, the receiver 10 is arranged on the table 20 such that the receiving surface 12 of the receiver 10 faces the first surface (front surface) of the table 20. Thus, the fusible toy beads creating table 1 is held in such a state as shown in FIG. 1. To arrange the receiver 10 on the table 20, firstly, the vertical ribs 14 of the wall parts 13 of the receiver 10 are inserted into the engagement holes 24*c* of the table 20, and the vertical ribs 14 opposite to the vertical ribs 14 inserted into the engagement holes 24*c* are inserted into the recesses 24*a* of the table 20. Edges 10*a* of the arranged receiver 10 on the sides of the long-side portions thereof come into contact with upper ends of the wall parts 24 on the sides of the long-side portions of the table 20 which face the edges 10*a*, and ends of the wall parts 13 of the receiver 10 come close to or come into contact with the upper surface of the first surface (front surface) of the table 20.

The outside surface of the wall part 13 of the receiver 10 arranged on the handle 22 side of the table 20 is brought into sliding contact with the vertical ribs 24*b* of the table 20. Thus, since the receiver 10 on the hinge part 5 is fixed, in the step of reversing the table 20, by holding the handle 22 together with the handle 11 facing the handle 22 by one hand, the receiver 10 and table 20 can be easily reversed together. Further, since the tray 30 includes the flat plate 36, erroneous rotation of the tray 30 in the same direction as the reversing rotation of the receiver 10 and table 20 due to the reversing operation thereof can be reduced.

Figure 8:
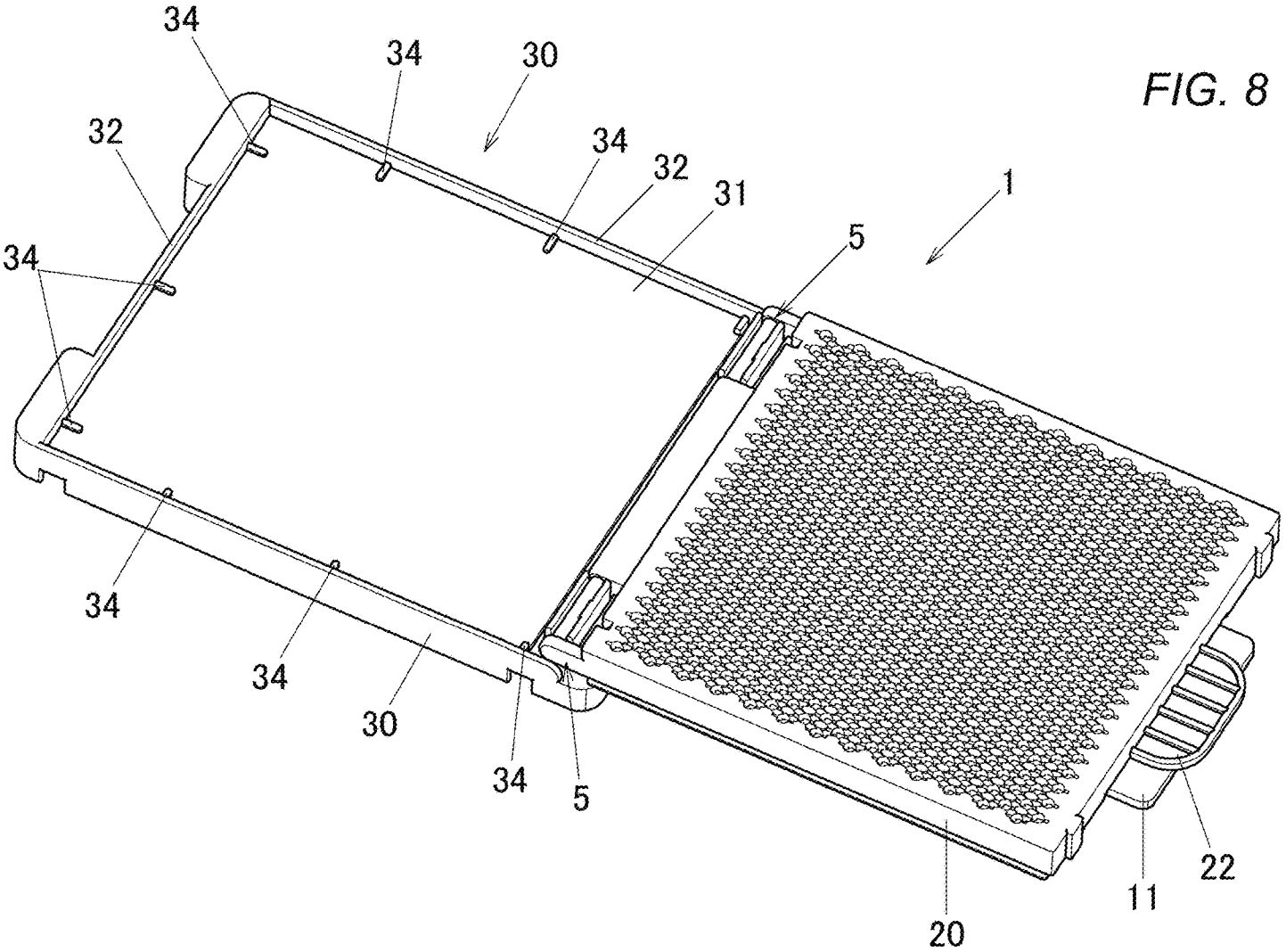
FIG. 8 is a perspective view showing a step of creating the assembly of fusible toy beads by the fusible toy bead creating apparatus according to the embodiment of the invention, specifically, a step of reversing the fusible toy bead creating apparatus and transferring the assembly of fusible toy beads to the receiver.
Figure 9:
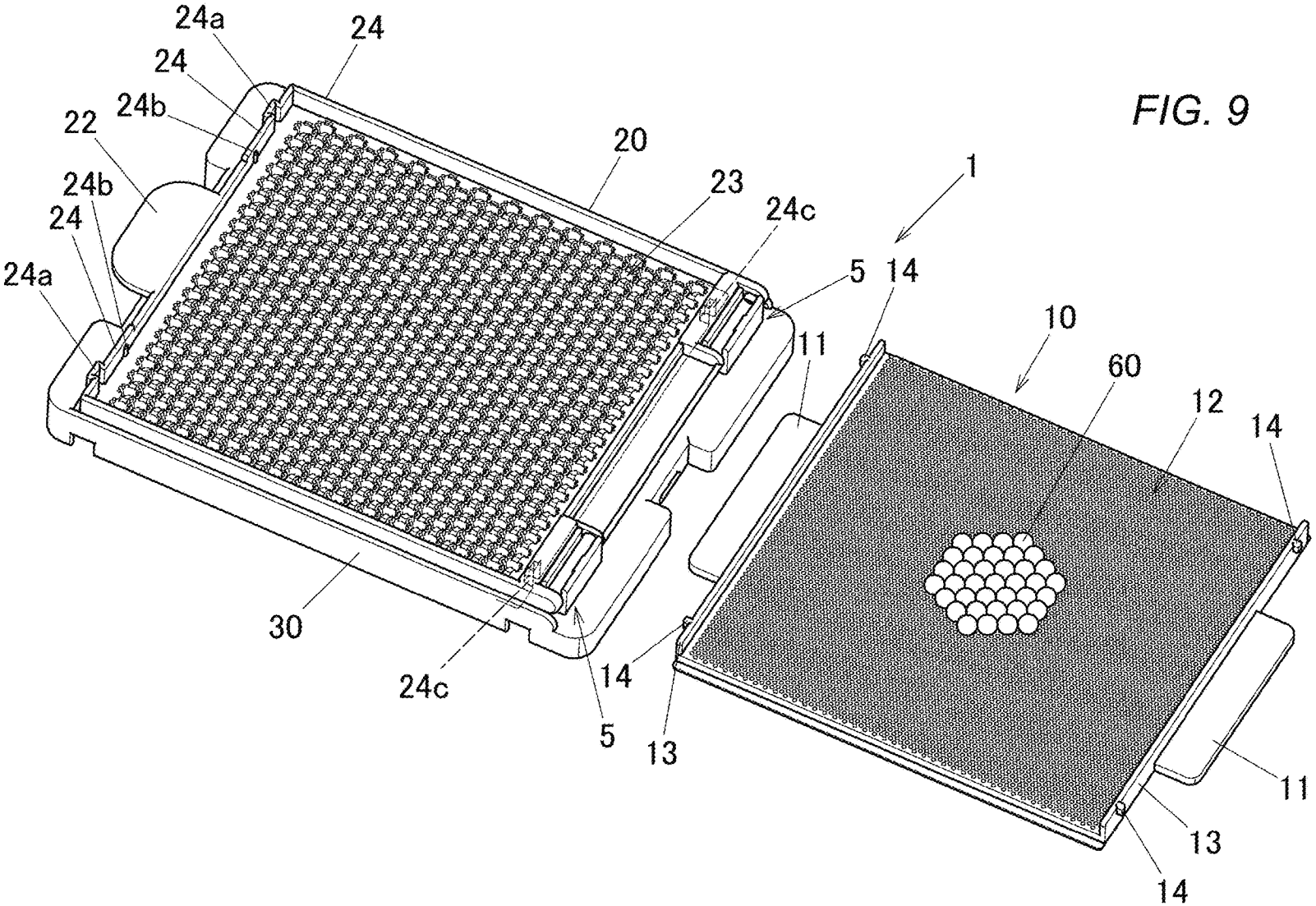
FIG. 9 is a perspective view showing a step of creating the assembly of fusible toy beads by the fusible toy bead creating apparatus according to the embodiment of the invention, specifically, a step of reversing again the fusible toy bead creating apparatus and returning the assembly of fusible toy beads to the tray.

After the receiver 10 is arranged on the table 20, as shown in FIG. 8, the table 20 is reversed. By returning the reversed table 20 onto the tray 30, as shown in FIG. 9, the plurality of fusible toy beads 60 on the placement part 23 of the table 20 are reversed and transferred onto the receiving surface 12 of the receiver 10. The plurality of fusible toy beads 60 placed on the receiving surface 12 of the receiver 10 are supported by the protrusions 12*a*. Thus, without being firmly adhered to the receiving surface 12, the toy beads 60 are allowed to slide on the receiving surface 12 and move from the receiving surface 12 onto a desk or the like for drying. In this manner, an assembly of fusible toy beads 60 having an arbitrary shape can be created. According to the fusible toy bead creating apparatus 1, immediately after the plurality of fusible toy beads 60 are placed on the placement part 23 of the table 20 and water is applied to them, the plurality of fusible toy beads 60 can be removed from the placement part 23. This makes it possible to immediately start to create a next assembly of fusible toy beads 60.

Also, the contact lengths of the hole edges 25*b* of the penetration holes 25 in the placement part 23 of the table 20 in line contact with the fusible toy beads 60 are small when compared with a case where the first surface side connecting grooves 26 (linear grooves 26*a*, inclined grooves 26*b*) are not equipped. Therefore, the welding forces of the plurality of fusible toy beads 60 placed on the placement part 23 of the table 20 to the placement part 23 are reduced even after application of water to them. Thus, in the reversing operation of the table 20, the fusible toy beads 60 can be easily transferred to the receiving surface 12 of the receiver 10. Further, since the first surface side connecting grooves 26 (linear grooves 26*a*, inclined grooves 26*b*) allow the applied water to flow into adjacent penetration holes 25 as well through the first surface side connecting grooves 26, the draining property of the table 20 is improved. Still further, since the penetration holes 25 are respectively formed in a tapered shape whose diameter reduces from the first surface side (front surface side) to the second surface side (back surface side), even such water as contains pasty components of the fusible toy beads 60 is easy to flow down onto the water receiving surface 31 of the tray 30 which is located below the penetration holes 25.

Since the plurality of fusible toy beads 60 are reversed before being dried and are removed from the table 20, warpage of the assembly of the fusible toy beads 60 caused when the front sides of the fusible toy beads 60 dry first is hard to occur.

According to one or more embodiments of the invention, fusible toy bead creating apparatuses respectively having the following aspects can be provided.

A fusible toy bead creating apparatus according to a first aspect includes: a table including a first surface and a second surface opposite to the first surface and having a plurality of penetration holes penetrating from the first surface to the second surface to allow fusible toy beads to be placed on the first surface; and a receiver including a receiving surface arranged to face the first surface of the table and configured to receive the fusible toy beads by reversing the receiver together with the table to move the fusible toy beads for drying.

According to this aspect, since an assembly of fusible toy beads placed on the table can be reversed and transferred to the receiver, immediately after water is applied to the assembly of fusible toy beads, the assembly of fusible toy beads can be removed from the table. Thus, it is possible to provide a fusible toy bead creating apparatus which can start in a short time to create a next assembly of fusible toy beads.

A fusible toy bead creating apparatus according to a second aspect further includes a tray provided on a second surface side of the table and including a water receiving surface.

According to this aspect, of water applied to the fusible toy beads, excess water flowing down from the table is received in the tray, thereby preventing a desk or the like with the creating table mounted thereon from getting wet with water.

In a fusible toy bead creating apparatus according to a third aspect, in hole edges of the penetration holes in the first surface of the table, first surface side connecting grooves connected to their adjacent ones of the penetration holes are formed.

According to this aspect, since water can be drained down efficiently through a large number of holes, it is possible to reduce the possibility that water applied to the assembly of fusible toy beads can remain on the table and, in the reversing operation of the table, can scatter around.

In a fusible toy beads creating table according to a fourth aspect, the penetration holes of the table have recess holes formed along an axial direction of the penetration holes.

According to this aspect, since water can be drained down more efficiently, it is possible to further reduce the possibility that water applied to the assembly of fusible toy beads can remain on the table.

A fusible toy bead creating apparatus according to a fifth aspect, in hole edges of the penetration holes in the second surface of the table, second surface side connecting grooves connected to their adjacent ones of the penetration holes are formed.

According to this aspect, a clearance, for example, between the water receiving surface of the tray and second surface side connecting groove respectively arranged on the second surface side (back surface side) of the table can be set large. Thus, it is possible to reduce the possibility that the table can stick to the water receiving surface of the tray or the like.

Figure 10:
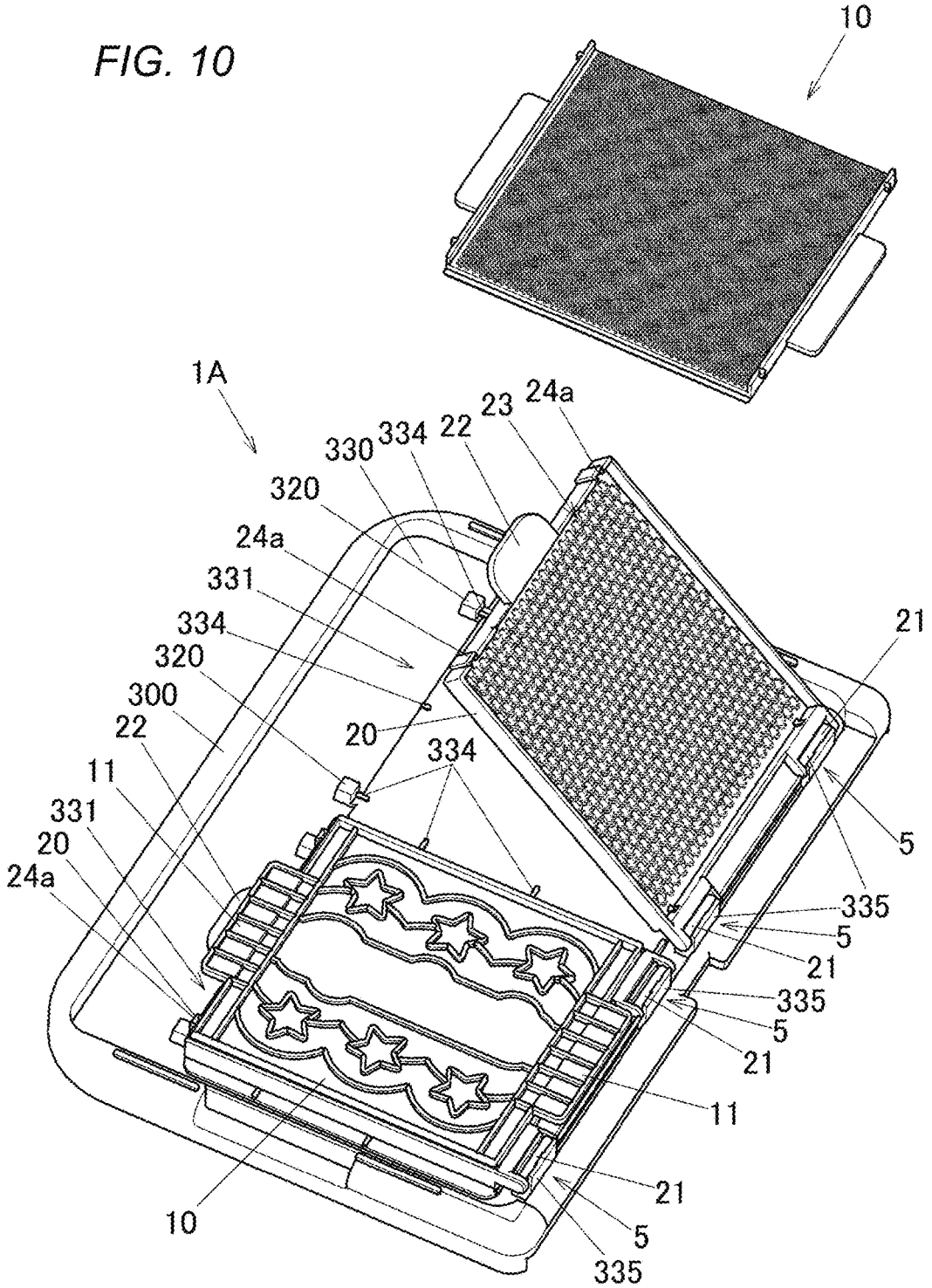
FIG. 10 is a perspective view of a modification of the fusible toy bead creating apparatus according to the embodiment of the invention.

Although the embodiment of the invention has been described above, the invention is not limited to the above embodiment but the invention can be carried out with various modifications. For example, when the tray 30 is increased in size, it is possible to provide a fusible toy bead creating apparatus including a plurality of receivers 10 and tables 20. FIG. 10 shows a modification of the fusible toy bead creating apparatus 1 and, specifically, shows a fusible toy bead creating apparatus 1A including two receivers 10 and two tables 20. The fusible toy bead creating apparatus 1A includes a recessed wide flat surface 330 the whole of which is formed in a substantially long rectangular shape and the outer periphery of which is formed like a wall. The flat surface 330 includes two water receiving surfaces 331 corresponding to the two tables 20.

Each water receiving surface 331 is a flat surface which is slightly higher than the flat surface 330. The water receiving surface 331 includes a plurality of support ribs 334 for receiving the back surface of the table 20. Also, a tray 300 includes two sets of shaft supports 335 which form hinge parts 5 together with the shafts 21 of the tables 20. Here, at positions facing the outside surfaces of the recesses 24*a* of the table 20, there are formed quadrangular prismatic guide blocks 320 respectively. The outside surface of each recess 24*a* comes close to or comes into sliding contact with the guide block 320. And, when the tables 20 are rotated and set onto the tray 300 by the hinge parts 5, the guide blocks 320 guide the outsides of the recesses 24*a*, thereby preventing blurring of the tables 20 even when the tables 20 are in use. Thus, according to the fusible toy bead creating apparatus 1A, equipment of the plurality of tables 20 makes it possible to start to create a next assembly of fusible toy beads 60 in a further shorter time and enables a plurality of persons to create assemblies of fusible toy beads 60 simultaneously.

According to the embodiment, although the table 20 is configured such that it can be reversed by the hinge parts 5, this is not limitative but there can also be employed other configurations, for example, it can be removed from the tray 30 and can be then reversed. Also, the penetration holes 25 of the table 20 are respectively formed to have a substantially circular cross section shape. However, an oval shape, a rectangular shape or the like may also be employed.

The invention claimed is:

1. A fusible toy bead creating apparatus comprising:

a table comprising a first surface and a second surface opposite to the first surface and having a plurality of penetration holes penetrating from the first surface to the second surface to allow fusible toy beads to be placed on the first surface;

a receiver comprising a receiving surface arranged to face the first surface of the table and configured to receive the fusible toy beads by reversing the receiver together with the table to move the fusible toy beads for drying;

a tray, wherein the tray is positioned opposite the second surface side of the table; and a hinge that connects the table and the tray.

2. The fusible toy bead creating apparatus according to claim 1, wherein the tray comprises a water receiving surface.

3. The fusible toy bead creating apparatus according to claim 1, wherein a first surface side connecting groove is adjacent to each of the plurality of penetration holes in the first surface of the table.

4. The fusible toy bead creating apparatus according to claim 1, wherein recess holes are adjacent to each of the plurality of penetration holes of the table, and wherein the recess holes are formed along an axial direction of the penetration holes.

5. The fusible toy bead creating apparatus according to claim 1, wherein a second surface side connecting groove is adjacent to each of the plurality of penetration holes in the second surface of the table.

* * * * *